United States Patent [19]

Lienemann

[11] 4,022,140

[45] May 10, 1977

[54] LOOPER DRIVE DEVICE FOR A STITCHING MACHINE

[75] Inventor: Ernst Lienemann, Kaufungen, Germany

[73] Assignee: VEB Nahmaschinenwerk Wittenberge, Wittenberge, Germany

[22] Filed: May 6, 1975

[21] Appl. No.: 575,095

Related U.S. Application Data

[63] Continuation-in-part of Ser. No. 547,414, Feb. 6, 1975, abandoned.

[52] U.S. Cl. ..... 112/199; 112/202; 112/220

[51] Int. Cl.[2] ..... D05B 57/02; D05B 57/30

[58] Field of Search ..... 112/197, 199, 200, 202

[56] References Cited

UNITED STATES PATENTS

| | | | |
|---|---|---|---|
| 933,407 | 9/1909 | Weis | 112/200 |
| 2,389,867 | 11/1945 | Muecke | 112/200 |
| 2,811,940 | 11/1957 | Marforio | 112/199 |
| 3,112,720 | 12/1963 | Bono | 112/200 |

*Primary Examiner*—George H. Krizmanich
*Attorney, Agent, or Firm*—Nolte and Nolte

[57] ABSTRACT

In a stitching machine having a main shaft, a stitching needle and a looper and means for driving the shuttle so that the looper effects thread loop seizing and dropping movements and needle evading movements, the improvement in which the means for driving the looper comprises a crank rigidly connected to the main shaft, a slide mounted on the crank for driving by the crank, the slide having a free end which is formed with an outer spherical surface and an inner spherical surface which is offset relative to the outer spherical surface, a guide cylinder having a segment shaped cut out, the outer spherical surface being received in and guided by the guide cylinder, a ball having a bore and being rotatably mounted in the inner spherical surface, a looper shaft for mounting the shuttle, a transmission lever having one end rigidly connected to the looper shaft and the other end in engagement with the bore in the ball.

4 Claims, 5 Drawing Figures

LOOPER DRIVE DEVICE FOR A STITCHING MACHINE

This is a continuation-in-part of application Ser. No. 547,414, filed Feb. 6, 1975, now abandoned.

This invention relates to a looper drive device for stitching machines, especially chain stitch sewing machines, in which the needle thread loop seizing and dropping movement of the looper and the needle evading movement of the looper are derived through gear connections from the main shaft with a crank and a slide spanning the crank.

Shuttle drive devices for stitching machines are known in which the elliptical movement of the looper is derived from two straight cranks or eccentrics.

Also known is a stitching machine in which the elliptical movement of the looper is obtained by a swash plate arranged eccentrically on the revolving main shaft, which swash plate is embraced by a wobble ring and transmits the mechanical impulses it receives to the looper.

Finally, it has been proposed to provide on the looper drive shaft a crank with a cylindrical slide spanning the crank, which slide glides in the operative state in cutouts in a rocker and on which an eccentric is fastened which imparts to the looper a lateral shifting movement.

A disadvantage common to all these looper drive devices is that the required cost of manufacture is high. The cause of this is the large number of drive members. The number of drive members is often increased further by the fact that another coupling member with an additional rocker is required to make room for the fabric transport means at the main shaft. Moreover, due to the relatively large number of members, a relatively great play necessarily results from the drive members to the looper. This disadvantage manifests itself in increased noise. Due to the high forces of inertia at increasing speeds of rotation, deformations of the individual drive members may also result. This affects in particular the additional coupling member, owing to which faults in the stitching operation may occur. As another disadvantage, it must be mentioned that looper drive devices having an additional coupling member are difficult to seal. It is possible only at great expense, if at all, to accommodate such a looper drive device in an enclosed oil chamber with central lubrication. Consequently, manual or wick lubrication must be used, which often leads to insufficient lubrication. Besides, there is increased fouling of the exposed drive member, which, in turn, leads to increased wear. Finally, these known looper drive devices for stitching machines cannot be used for the very high stitching rates demanded by the industry today.

It is an object of the invention to provide a looper drive device in which the aforementioned disadvantages are obviated and with which even at maximum stitching rates of over 7,000 stitches per minute, satisfactory stitch chains or seams are formed with minimal noise. Other objects and advantages of the invention will be apparent from the following description thereof.

The looper drive device of the present invention for stitching machines ensures safisfactory stitch formation with but few components and at high stitching speeds.

According to the invention, the slide is sphere-like near its free end inside and out, the outer sphere gliding in a segment type guide cylinder, and a sphere having a bore being rotatably mounted in the inner sphere which is arranged offset to the outer sphere. A transmission lever connected with the looper shaft engages in the bore.

According to another feature of the invention, the crank is designed as a spherical, i.e., ball and socket, joint.

The terms "sphere" annd "spherical" or "sphere-like" are being used herein to describe configurations which are portions of spheres, in the interest of concise terminology. This practice is common as illustrated by the common practice of referring to the parts of a ball and socket joint as being spherical even though the parts are not complete spheres.

Yet another feature of the invention is that on the end faces of the segment type cut-out of the guide cylinder retaining members are fastened to the guide cylinder.

With the looper drive device of the invention for stitching machines, it has become possible to derive the elliptical movement for the looper from only one drive means, owing to which structural space is saved, high stitching rates are attainable, and a closed oil space for central lubrication can be provided.

Specific embodiments of the invention are illustrated in the drawings, in which.

Figure 1:
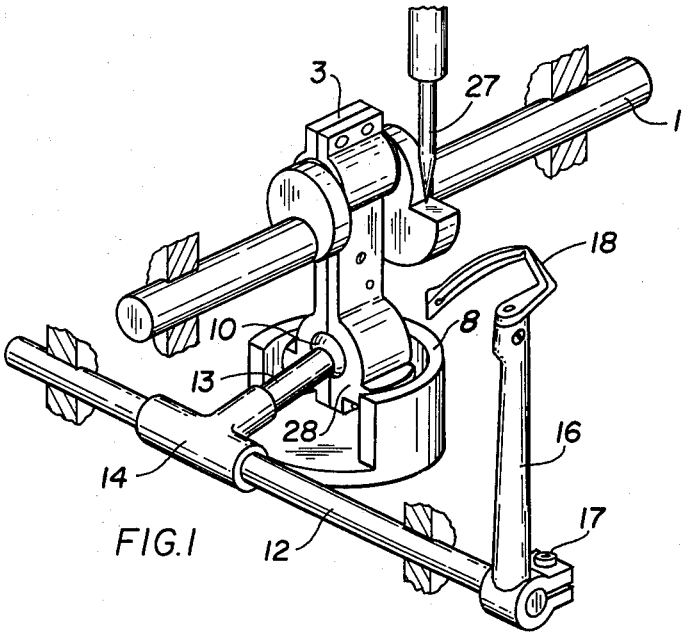
FIG. 1 is a perspective view of a looper drive device of the invention for a chain stitch sewing machine.
Figure 2:
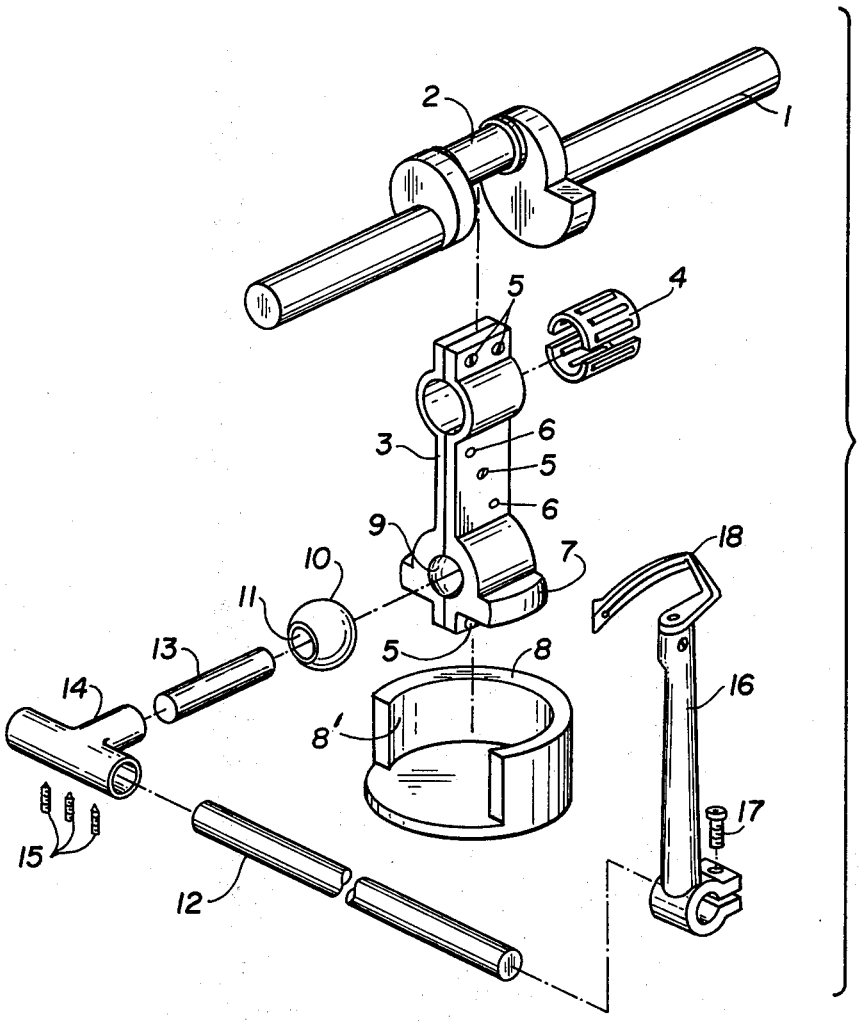
FIG. 2 is an exploded perspective view showing all the individual parts of the looper drive device of FIG. 1.

On the main shaft 1, a crank 2 is provided, which is spanned by a slide 3 and a needle bearing 4 lying between the crank 2 and the slide 3 (FIGS. 1 and 2). For assembly, the slide 3 is fitted together from two parts which are clamped by screws 5 and secured by means of straight pins 6. At the lower end, slide 3 is spherical inside and out. It will be understood that the terms "sphere" and "spherical" are being employed herein to describe configurations which are portions of spheres or are sphere-like, for the sake of permitting concise terminology; this practice is common as illustrated by the conventional practice of referring to a ball and socket joint as involving spherical members when the members are, of course, not complete spheres in their configurations. The outer sphere 7 is slidably mounted by the segment shaped inner surface of a guide cylinder 8. The guide cylinder 8 is firmly connected with the machine frame of a chain stitch sewing machine. As clearly shown in FIG. 1, the center of the inner sphere 9 is arranged offset to the center of the outer sphere 7 of the slide 3. Inside the inner sphere 9 a sphere or ball element 10 having a bore 11 is movably mounted, in which bore there is slidably engaged a transmmission lever 13. By means of a T-shaped lever 14 and fastening screws 15, the transmission lever 13 is connected to the looper shaft 12. On the looper shaft 12, the looper rocking lever 16 is fastened by means of a screw 17. The amount of longitudinal movement of the looper 18 is determined by the crank radius R of the crank 2, the distance of the center of the inner sphere 9 and sphere 10 from the pivot point of the looper shaft 12 and by the distance of the looper tip from the center of the looper shaft 12. Alteration of the longitudinal movement of the looper may expediently be effected by adjustment of the distance between the inner sphere 9 and the pivot point of the looper shaft 12. With this alteration of the longitudinal movement of the looper, however, the shuttle evasion movement remains unchanged in its magnitude. By a lateral displacement of the guide cylinder 8, an irregular elliptical movement is obtained, and this can be utilized for secure loop catching.

Thus, in the embodiment shown, the offset position of the concave inner sphere-like surface 9 is effected by placing the center of such surface 9 above the center of the convex outer surface 7.

Figure 3:
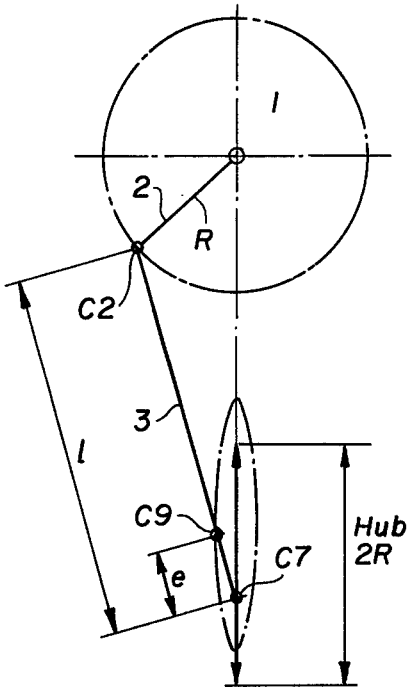
FIG. 3 is a schematic view of the shuttle drive device illustrating the obtaining of the elliptical path of the looper.

In FIG. 3, l is the distance between the center C2 of the crank 2 and the center C9 of the inner sphere 9, when crank 2 is in the intermediate position about the center of the axis of shaft 1, *e* is the distance between the centers C9 and C7 of the inner sphere 9 and the center of the outer sphere 7 respectively of the slide 3 and "Hub 2R" is the distance between the upper and the lower dead center positions of the bottom of the slide 3.

Figure 4:
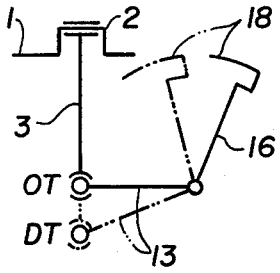
FIG. 4 is a schematic view of the looper drive device illustrating the obtaining of an irregular elliptical path for better stitch formation.

As can be seen from FIG. 4, changing the length of the transmission lever 13 leads to a more fault-free stitching operation. The looper 18 swings faster out of its front dead center than out of its rear dead center, owing to which the loop of the needle thread is siezed more securely. The upper OT and lower UT dead center positions of slide 3 are visible from FIG. 4.

Figure 5:
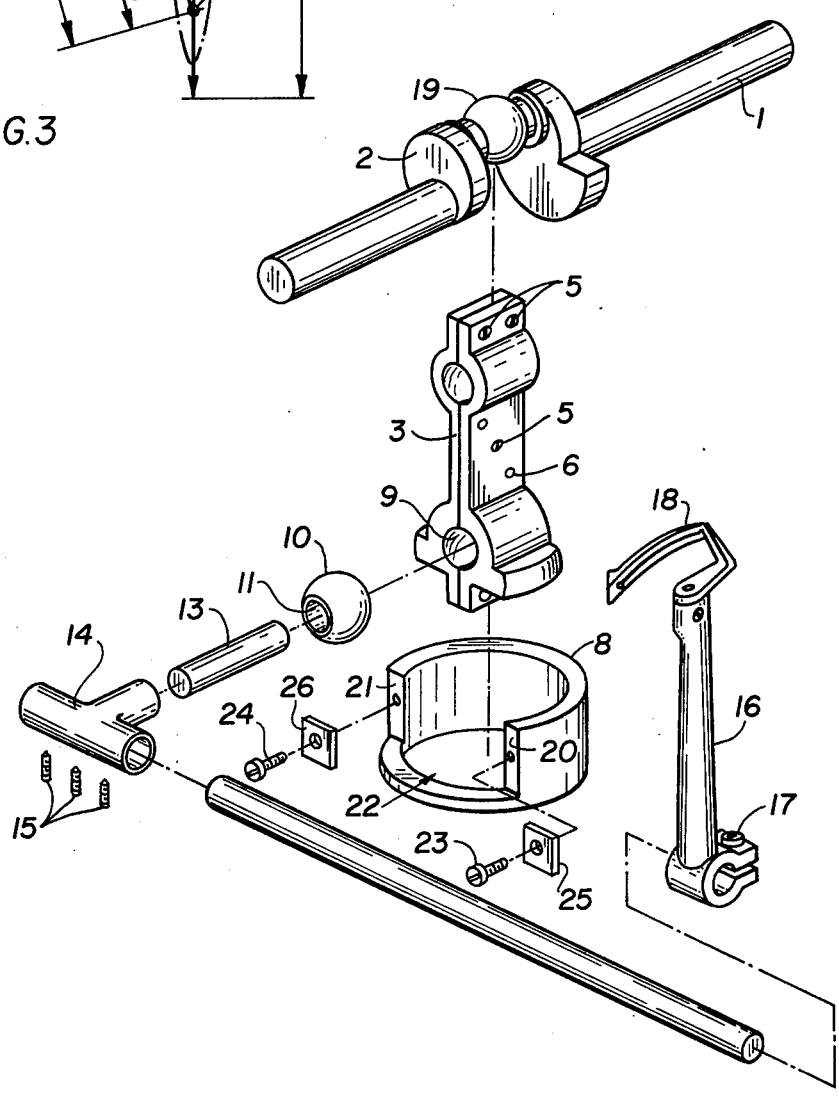
FIG. 5 is an exploded perspective view of a looper drive device of the invention in which the crank is designed as the ball of a spherical (ball-and-socket) joint and the individual parts are illustrated.

The embodiment of FIG. 5 is generally like the embodiment of FIG. 2. In FIG. 5, the crank 2 is designed as the ball 19 of a spherical (ball-and-socket) joint. Therefore, the slide 3 is spherical internally in its upper portion since it is the socket of the joint. To secure the positioning, retaining members 25, 26 are fastened at the end faces 20, 21 of the segment shaped cut-out 22 in the guide cylinder 8 by means of screws 23, 24.

The mode of operation of the device is as follows:

Upon rotation of the main shaft 1, the slide 3 is moved from the upper dead center position into the lower dead center position (FIGS. 3 and 4). This movement is transmitted via the ball and socket joint connection consisting of ball 10, bore 11 and lever 13, to the looper shaft 12, so that the looper 18 performs a to and from movement relative to the looper shaft 12. At the same time, the outer sphere-like surface 7 moves along the inner wall of the guide cylinder 8 (described by a segment-shaped cutout 8') which is affixed to the machine, whereby the inner sphere-like concave surface 9, due to its eccentric position relative to the outer sphere describes the elliptical path shown in FIG. 3.

The thus produced movement component in the direction of the looper shaft 12 is transmitted via the transmission lever 13 to the looper shaft 12 and thereby to the looper 18. Both these movements produce, in combination, an elliptical curve at the looper tip.

With the new looper drive devices of the invention for stitching machines, the highest stitching rates can be obtained at low cost for construction. Moreover, low noise and an oil-proof sealing have been made possible.

What is claimed is:

1. In a stitching machine having a main shaft, a stitching needle and a looper and means for driving the looper so that the looper effects thread loop seizing and dropping movements and needle evading movements, the improvement in which the means for driving the looper comprises a crank rigidly connected to the main shaft, a side mounted at one of its ends on the crank for driving by the crank for rotational movement about the axis of the main shaft, the slide having a free end which is formed with an outer convex spherical-like surface and an inner concave spherical-like surface, the center of the inner spherical-like surface being offset relative to the center of the outer spherical-like surface, a guide cylinder having a segment-shaped inner surface, the outer spherical-like surface being received in and guided by the inner surface of the guide cylinder, a ball element having a bore and being rotatably mounted in the inner concave spherical-like surface, a looper shaft mounting the looper, a transmission lever having one end rigidly connected to the looper shaft and the other end in sliding engagement with the bore in the ball element whereby said ball element is moved longitudinally and laterally in an elliptical path and said transmissions element transmits such movement to the looper shaft and looper.

2. In the improvement in a stitching machine according to claim 1, the crank being in the form of the ball of a ball-and-socket joint and the slide at its mounting on the crank being in the form of the socket of the joint.

3. In the improvement in a stitching machine according to claim 1, in which end faces are formed on the wall of the guide cylinder at the extremities of the segment shaped cut-out and the looper driving means further comprise retaining members secured to said end faces for retaining the free end of said slide in said guide cylinder.

4. In the improvement in a stitching machine according to claim 2, in which end faces are formed on the wall of the guide cylinder at the extremities of the segment shaped cut-out and the looper driving means further comprise retaining members secured to said end faces for retaining the free end of said slide in said guide cylinder.

* * * * *

UNITED STATES PATENT OFFICE

CERTIFICATE OF CORRECTION

PATENT NO. : 4,022,140

DATED : May 6, 1975

INVENTOR(S) : ERNST LIENEMANN

It is certified that error appears in the above-identified patent and that said Letters Patent are hereby corrected as shown below:

Column 4, line 51, Delete "cut-out" and insert --surface of the guide cylinder--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*